US008082706B2

(12) United States Patent
Myny et al.

(10) Patent No.: US 8,082,706 B2
(45) Date of Patent: Dec. 27, 2011

(54) STORM PANEL SECURED TO A BUILDING OPENING VIA STRAP ATTACHED TO MOUNTING TRACKS

(75) Inventors: Jerry Lawrence Myny, Algonac, MI (US); Donee Lois Myny, Algonac, MI (US)

(73) Assignee: Got A Strap, LLC, Algonac, MI (US)

( * ) Notice: Subject to any disclaimer, the term of this patent is extended or adjusted under 35 U.S.C. 154(b) by 0 days.

(21) Appl. No.: 12/905,603

(22) Filed: Oct. 15, 2010

(65) Prior Publication Data

US 2011/0067347 A1 Mar. 24, 2011

Related U.S. Application Data

(63) Continuation-in-part of application No. 12/564,869, filed on Sep. 22, 2009, now abandoned.

(51) Int. Cl.
*E06B 9/02* (2006.01)

(52) U.S. Cl. ..... 52/202; 49/57; 49/61

(58) Field of Classification Search ..... 52/202, 52/506.01, 506.05, 475.1, 781.3; 49/57, 49/61, 62, 463; 2/338
See application file for complete search history.

(56) References Cited

U.S. PATENT DOCUMENTS

| | | | | |
|---|---|---|---|---|
| 1,963,309 | A * | 6/1934 | Muller | 2/338 |
| 3,810,338 | A | 5/1974 | Wolfert | |
| 4,062,394 | A | 12/1977 | Anderson et al. | |
| 5,161,345 | A * | 11/1992 | Sobjack, Sr. | 52/745.05 |
| 5,197,239 | A * | 3/1993 | Glynn et al. | 52/63 |
| 5,661,935 | A | 9/1997 | Erickson et al. | |
| 5,768,833 | A | 6/1998 | Golen | |
| 6,244,558 | B1 | 6/2001 | Castle | |
| 6,393,777 | B1 | 5/2002 | Renfrow | |
| 6,532,702 | B1 | 3/2003 | Scribner | |
| 6,978,579 | B1 | 12/2005 | Trinca | |
| 2003/0135913 | A1 * | 7/2003 | Yang | 2/338 |
| 2004/0042875 | A1 * | 3/2004 | Huang | 411/442 |
| 2006/0179736 | A1 | 8/2006 | Bieber et al. | |
| 2007/0000193 | A1 | 1/2007 | Beaupre et al. | |
| 2007/0107328 | A1 | 5/2007 | Munch | |

FOREIGN PATENT DOCUMENTS

WO WO-2007103692 A2 9/2007

* cited by examiner

*Primary Examiner* — Michael Safavi
(74) *Attorney, Agent, or Firm* — Jelic Patent Services, LLC; Stanley E. Jelic

(57) ABSTRACT

A strap to secure bolts at a proper spacing for installing a storm panel to a track using bolts and fasteners. The strap holds the bolts in place, allowing ease of storm panel installation. The storm panels are typically used to protect building openings, such as windows and doors, during periods of bad weather. The storm panels may also be used for security purposes.

2 Claims, 4 Drawing Sheets

STORM PANEL SECURED TO A BUILDING OPENING VIA STRAP ATTACHED TO MOUNTING TRACKS

CROSS-REFERENCE TO RELATED APPLICATIONS

This application is a continuation-in-part of prior application Ser. No. 12/564,869, filed Sep. 22, 2009 now abandoned.

BACKGROUND OF THE INVENTION

A storm panel, also known as a hurricane panel, is used to protect a building opening, such as a door or window, during severe weather. The storm panel may also be used for security. There are many different types of mounting brackets used for storm panels installation. One method of mounting the storm panel is to install "F" track horizontally and/or vertically on the sides of the window or door openings. Then, bolts are placed in the track by sliding one bolt at a time by hand, the storm panel is mounted on the bolts, and the storm panel is secured with wing nuts.

BRIEF SUMMARY OF THE INVENTION

The present disclosure describes a strap to secure bolts at a proper spacing for installing a storm panel with mounting holes to an "F" track using bolts and fasteners, the bolts consisting of a bolt shaft connected to a bolt head, the track having a thickness and width for receiving the bolt heads, the storm panels being used to protect a building opening, and the strap comprising: a flexible material with two parallel sides, a top end connecting the parallel sides, a bottom end connecting the parallel sides, and a thickness between 1/64" and 1/2"; and a plurality of circular openings for holding the bolts in place to mount the storm panel with mounting holes, the bolt heads held approximately 1/16 of an inch from the material, the openings centered between the two parallel sides of the material, the bolt heads being unable to pass through the material, the openings being equidistant from each other, and the openings having a smaller diameter than the bolt shaft diameter. The storm panels are typically used to protect building openings, such as windows and doors, during periods of bad weather. The storm panels may also be used for security purposes.

The bolts are threaded into the strap, where they are held in place. The bolt heads are then individually slid into the track and the strap is used to pull the bolts into the proper position to receive the storm panels. The storm panel is mounted on the bolts and then secured with fasteners such as wing nuts.

The strap has a thickness between 1/64" and 1/2" an inch. The thickness affects the ease of holding the bolts in place. The strap comprises a flexible material including leather, nylon, polypropylene, polyester, cloth, nylon webbing, polypropylene webbing, nylon webbing, or the like. Strap lengths can vary since the strap is cut during installation to match the length of track. The strap holes may be reinforced with grommets or strengthened with a coating to minimize wear from installing and removing bolts.

The strap has smaller hole diameters than the bolts it receives, so that the bolts are held tightly to prevent them from falling out. The strap openings are also properly spaced to match the storm panel openings. The bolts are threaded into the openings instead of being pushed through. Threading minimizes damage to the strap opening and enables the strap to better hold the bolt in place. The bolts are not fully threaded, so that a gap is left between the bolt head and the strap.

In one embodiment, the strap has a trapezoidal-shaped or rectangular shape, consists of a polypropylene webbing material, has a width of 1 inch, has a thickness between 0.50 and 0.55 inches, has a tensile strength of at least 800 pounds, has circular openings with a diameter of 3/16 of an inch for securely holding larger diameter 1/4-20 sized bolts, the circular openings spaced approximately 6 inches apart, the bolts consisting of a bolt shaft connected to a bolt head, and the bolt heads being securely held approximately 1/16 of an inch from the strap.

DETAILED DESCRIPTION OF THE INVENTION

Figure 1:
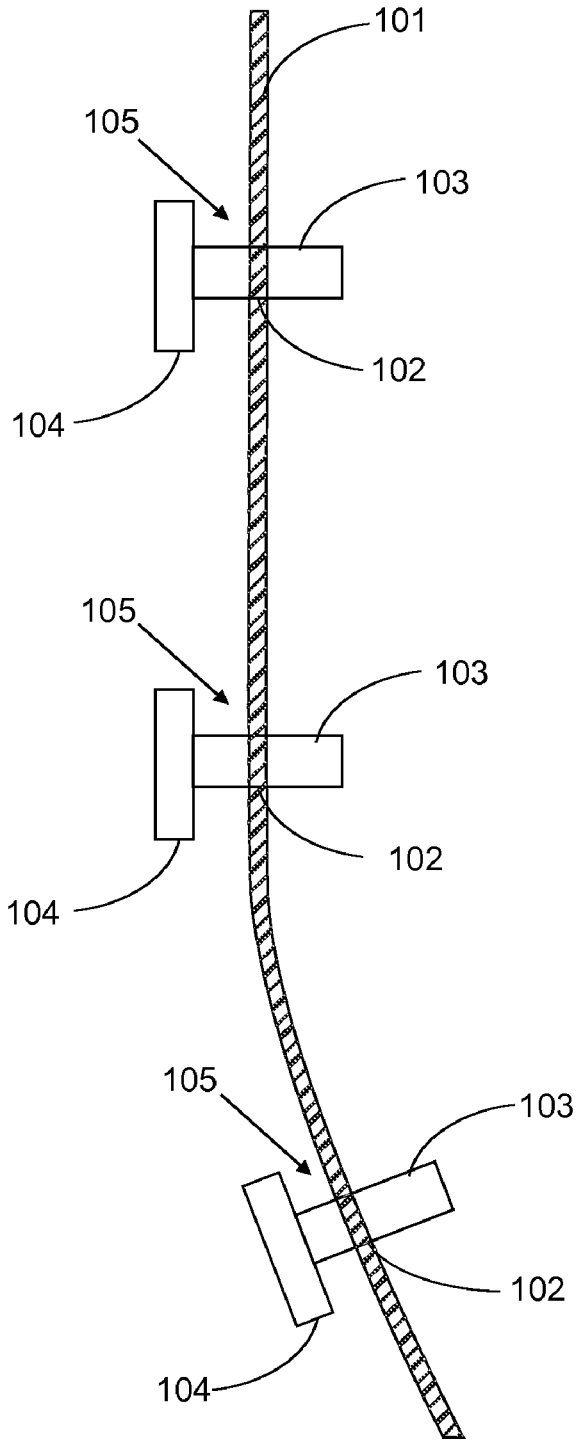
FIG. 1 shows a cross-section side view with bolts threaded into a strap.

A storm panel is used to protect a building opening, such as a door or window, during severe weather. The storm panel may also be used for security. There are many different types of mounting brackets used for storm panel installation. One method of mounting the storm panel is to install "F" track horizontally and/or vertically on the sides of the opening. Then, bolts are placed in the track by sliding one bolt at a time by hand, the storm panel is mounted on the bolts, and the storm panel is secured with wing nuts.

One problem with the above method is that the bolts are loose in the track. Hence, the bolts may not lie perpendicular to the building and may not easily fit into storm panel mounting holes. The problem is especially acute in vertical installations where gravity forces the bolts to slide downward in the track. Therefore, mounting the storm panel requires at least one additional person to simply hold the bolts in place. Larger storm panels can come in lengths of 88 and 102 inches. When mounting these larger panels vertically, the bolts can be forced out of alignment during installation.

The present disclosure solves the above problem with a strap for use in mounting storm panels. The strap enables bolts to be installed in a track and held in place during storm panel mounting. Therefore, no one is required to hold the bolts in place during mounting. The strap also saves installation time and is more efficient when time is of the essence with a storm imminent. It allows one person to install storm panels when no other individual is available to help, no matter how long the storm panel is. This is very important on a commercial building.

One unexpected result of using the strap is that it prevents metal on metal wear, scratching, and nicking.

Another unexpected result of using the strap is that the storm panels are much quieter in bad weather. This is because the amount of "metal on metal" contact is reduced.

Another unexpected result is that the strap may be easily stored with the bolts installed. This saves time every time that the storm panels are reinstalled, after the first installation. Note that the strap is flexible and bending it does not affect its future utility. Also, the strap is able to last for many years because of its material of construction.

Another unexpected result is that it is now easier to place storm panels on each end of the building opening, allowing light or an object to pass through the unobstructed portion of the building opening.

Directions for using the present invention in a vertical installation are as follows. First, mount "F" track vertically onto the building on both sides of the building opening. Second, cut the strap to match the length of the track. Third, thread bolts through holes, leaving a 1/16 inch gap between the head of the bolts and the strap. Fourth, start at the top of the track, install the bolt heads in the track, and slide them down the track until all of the slack is taken out of the strap. Fifth, secure the uppermost bolt with a fastener at the proper height for storm panel installation. Sixth, repeat the second through the fifth steps for the other side of the building opening. Make sure that the bolts on both sides of the building opening are aligned at the same height. Seventh, place a storm panel on the three (3) lowest bolts and secure a fastener onto the center bolt of both sides of the storm panel. Eighth, secure fasteners onto the remaining bolts of the lowermost storm panel. Ninth, install additional storm panels. Tenth, prior to installing the final storm panel, remove fastener from the uppermost bolt.

Directions for using the present invention in a horizontal installation are as follows. First, mount "F" track on the top and bottom of the building opening. Second, cut the strap to match the length of the "F" track. Third, thread bolts through holes, leaving a 1/16 inch gap between the head of the bolts and the strap. Fourth, install the bolt heads in the track and slide them across the track until all of the slack is taken out of the strap. Sixth, repeat the second through the fourth steps for the other side of the building opening. Make sure that the bolts on the top and bottom of the building opening are aligned. Seventh, place a storm panel on three (3) bolts and secure a fastener onto the center bolt of both sides of the storm panel. Eighth, secure fasteners onto the remaining bolts of the first storm panel. Ninth, install additional storm panels. Note that if the strap is too short, more than one strap may be used in series by overlapping the end bolt and the added strap.

Note that it is possible for a storm panel to have more or less than three (3) openings. In that case, the above directions would be modified accordingly.

While descriptions of vertical and horizontal installations are given above, the descriptions are not meant to be limiting. Storm panel installations may occur in many angles and positions, being limited only by the location of building openings which must be protected.

FIG. 1 shows a cross-section side view with bolts threaded into a strap. The strap 101 has a plurality of openings 102. The bolts 103 are threaded into the strap openings 102. A gap 105 exists between each bolt head 104 and the strap 101.

Figure 2:
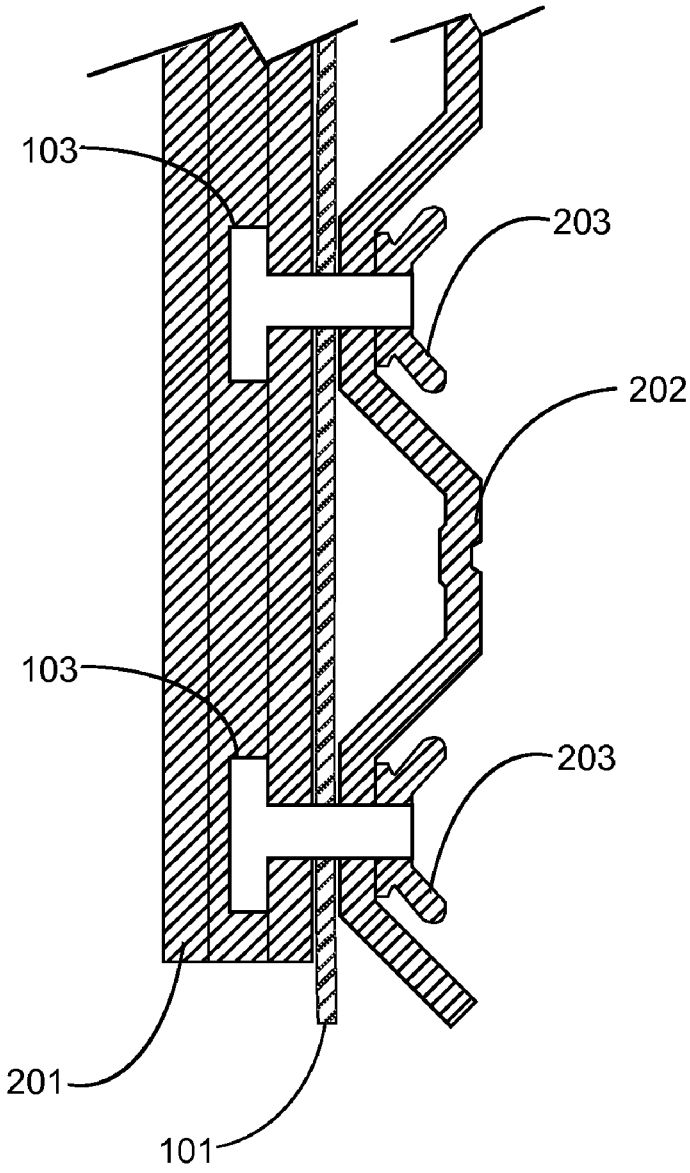
FIG. 2 shows a cross-section side view of a vertical storm panel installation.

FIG. 2 shows a cross-section side view of a vertical storm panel installation. The bolts 103 sit in a track 201. The bolts 103 are held in position with the strap 101 which is adjacent to the track 201. A storm panel 202 is mounted on the bolts 103 and is adjacent to the strap 101. The storm panel 202 is secured with fasteners 203 which thread onto the bolts 103. In this example, the fasteners 203 are wing nuts but many types of fasteners are possible.

Figure 3:
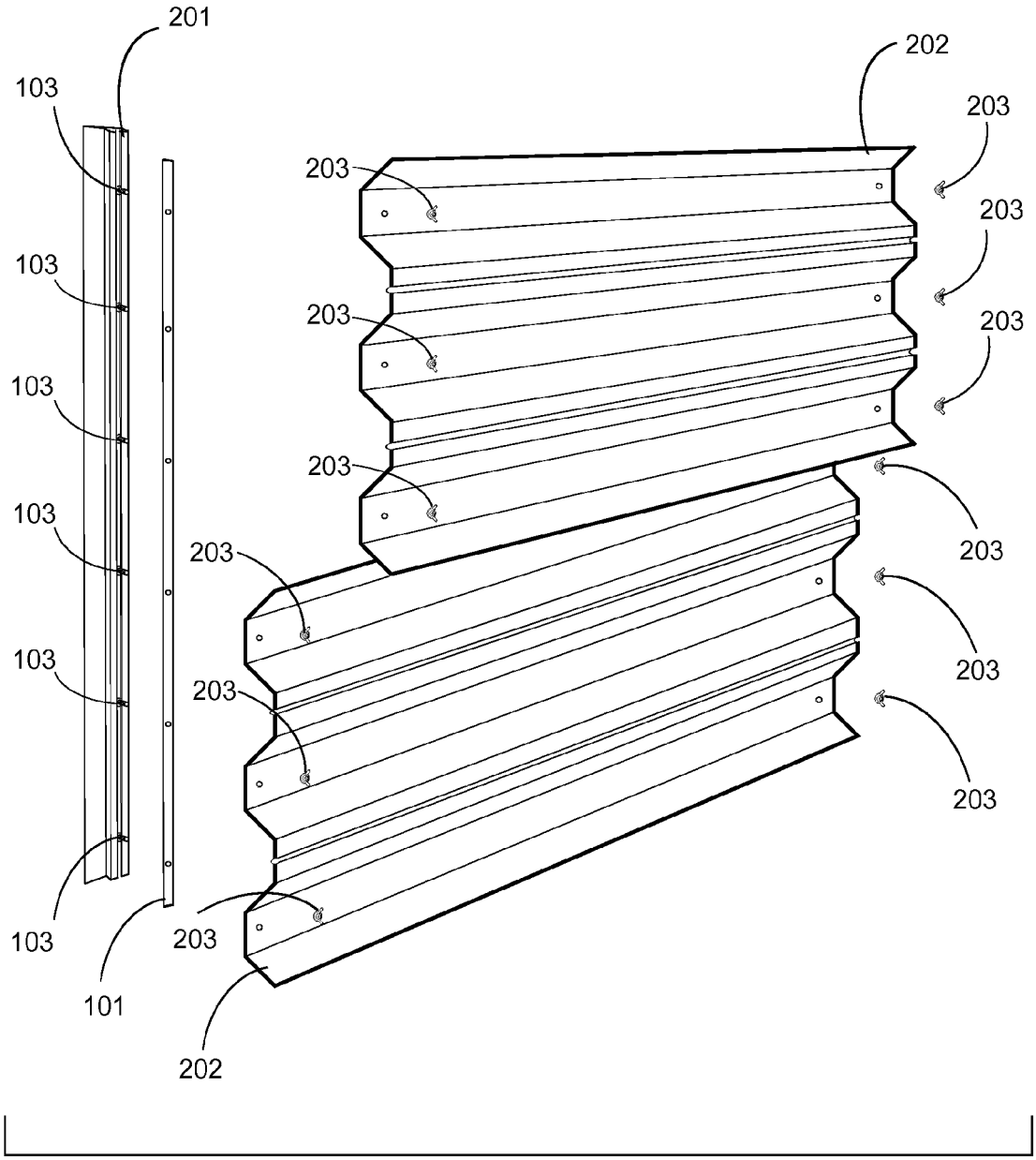
FIG. 3 shows an exploded view of a horizontal storm panel installation.

FIG. 3 shows an exploded isometric view of a horizontal storm panel installation. The bolts 103 sit in a track 201. The bolts 103 are held in position with the strap 101 which is adjacent to the track 201. A storm panel 202 is mounted on the bolts 103 and is adjacent to the strap 101. The storm panel 202 is secured with fasteners 203 which thread onto the bolts 103. In this example, the fasteners 203 are wing nuts but many types of fasteners are possible.

Figure 4:
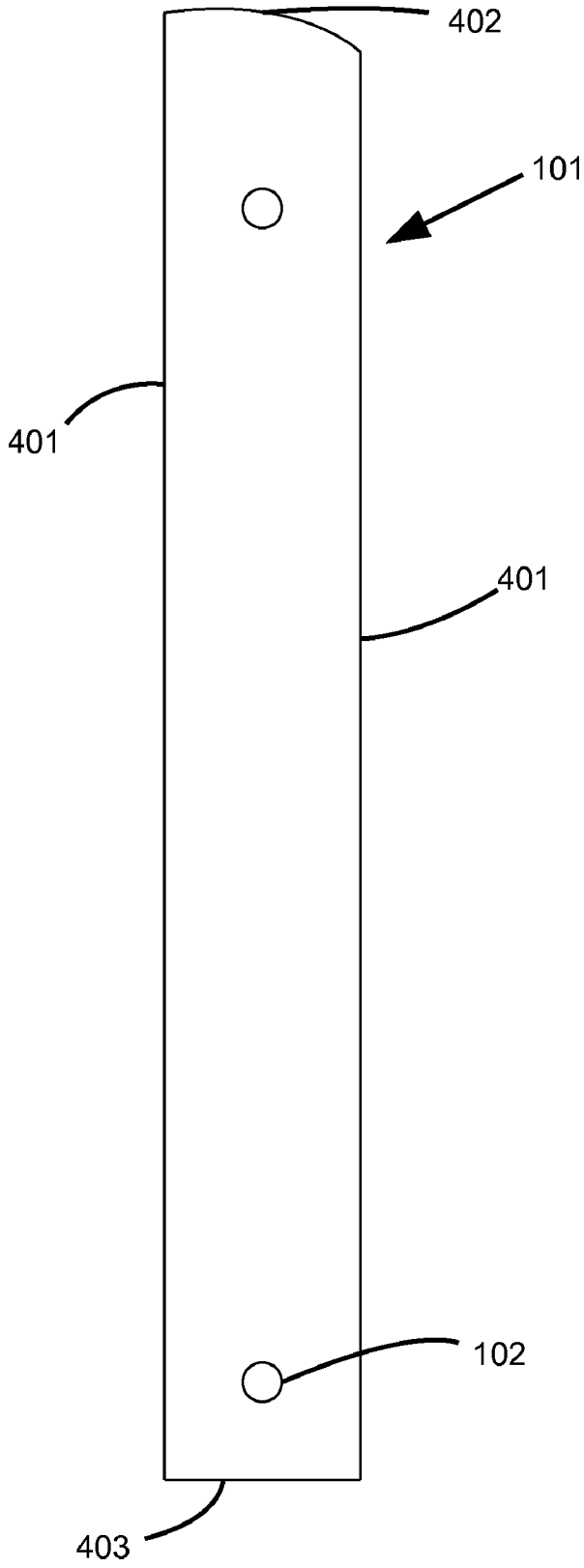
FIG. 4 shows a front view of an embodiment of the strap.

FIG. 4 shows a front view of an embodiment of the strap. The strap 101 has two long parallel sides 401 with a plurality of openings 102 which are circular and evenly spaced. There is a top end 402 and bottom end 403. The openings 102 are centered between the two long parallel sides 401.

While the present invention has been described herein with reference to an embodiment and various alternatives thereto, it should be apparent that the invention is not limited to such embodiments. Rather, many variations would be apparent to persons of skill in the art without departing from the scope and spirit of the invention, as defined herein and in the claims.

We claim:

1. An apparatus to protect a building opening, the apparatus comprising:

a strap comprising:

a flexible material with two parallel sides, a top end connecting the parallel sides, a bottom end connecting the parallel sides, and a thickness between 1/64" and 1/2"; and a plurality of circular openings which are centered between the two parallel sides of the material and equidistant from each other;

a plurality of bolts mounted in the circular openings, the bolts consisting of a cylindrical bolt shaft connected to a bolt head, the bolt heads held approximately 1/16 of an inch from the material, and the bolt shaft diameters being slightly larger than the circular openings so that the bolts are held in place;

an F track secured to each of opposing sides of the building opening, the bolt heads are positioned within the strap, equidistant, and mounted in the slot of one of the F track;

a storm panel with equidistant mounting holes which is mounted onto the bolts at the mounting holes; and a plurality of fasteners threaded onto the bolts, securing the storm panel and the strap to the F track.

2. An method to protect a building opening, the method comprising:

using a strap comprising:

a flexible material with two parallel sides, a top end connecting the parallel sides, a bottom end connecting the parallel sides, and a thickness between 1/64" and 1/2"; and a plurality of circular openings which are centered between the two parallel sides of the material and equidistant from each other;

mounting a plurality of bolts in the circular openings, the bolts consisting of a cylindrical bolt shaft connected to a bolt head, the bolt heads held approximately 1/16 of an inch from the material, and the bolt shaft diameters being slightly larger than the circular openings so that the bolts are held in place;

securing an F track to each of opposing sides of the building opening, the bolt heads are positioned within the strap, equidistant, and mounted in the slot of one of the F track;

mounting a storm panel with equidistant mounting holes onto the bolts at the mounting holes; and threading a plurality of fasteners onto the bolts, securing the storm panel and the strap to the F track.

* * * * *